United States Patent [19]

Grunwald

[11] Patent Number: 4,888,518

[45] Date of Patent: Dec. 19, 1989

[54] GAS CIRCULATION APPARATUS FOR CERAMIC ELECTRON TUBES

[75] Inventor: Henry C. Grunwald, Bethlehem, Pa.

[73] Assignee: ITT Corporation, New York, N.Y.

[21] Appl. No.: 122,304

[22] Filed: Nov. 16, 1987

[51] Int. Cl.[4] ..... H01J 1/46

[52] U.S. Cl. ..... 313/40; 313/231.01; 313/595; 313/597; 313/598; 313/599

[58] Field of Search ..... 313/40, 597, 609, 22–24, 313/595, 599, 598, 231.01

[56] References Cited

U.S. PATENT DOCUMENTS

| | | | |
|---|---|---|---|
| 2,479,529 | 8/1949 | Watrous, Jr. et al. | 313/597 |
| 2,951,960 | 9/1960 | Watrous, Jr. | 313/597 X |
| 3,885,183 | 5/1975 | Menown et al. | 313/593 |
| 4,577,138 | 3/1986 | Menown et al. | 313/599 |
| 4,703,226 | 10/1987 | Menown | 313/599 X |

*Primary Examiner*—Donald J. Yusko
*Assistant Examiner*—Michael Horabik
*Attorney, Agent, or Firm*—Thomas N. Twomey; Mary C. Werner

[57] ABSTRACT

A structure associated with a ceramic envelope gas filled electron tube whereby a series of concentric holes are formed through grid radiator rings which thus simulates the outer neutral gas region of a typical glass envelope tube structure. In this manner, one has created a neutral non-ionized gas flow path which shunts the main discharge in such a thyratron and which is contained within the metal internal axial structure. The apertures, as formed in the grid radiator rings, thereby provide a source path for neutral molecular hydrogen from the gas reservoir located at the base of the tube to allow the gas to be directed to the anode/grid region of the tube, where electrons are pumped and the gas is collisionally ionized. The effect serves to enhance the maximum thyratron operating frequency by allowing cool neutral gas molecules to flow into the gap region through the parallel path and then into the discharge volume of the ceramic thyratron tube. Thus, the use of such structure provides an increased maximum conduction current rating and, therefore, a greater switching capability for a ceramic gas filled tube.

20 Claims, 3 Drawing Sheets

GAS CIRCULATION APPARATUS FOR CERAMIC ELECTRON TUBES

BACKGROUND OF INVENTION

This invention relates to electron or vacuum tubes in general and, more particularly, to a gas circulation means which can be employed in conjunction with a gas filled electron tube, such as a thyratron of ceramic construction.

The prior art is replete with a number of gas filled electron tubes which have been employed extensively as high power devices. Early design tubes, as one is well aware of, are fabricated from glass and have glass envelopes, for example, and other glass supporting structures. There is, however, a modern variety of high power vacuum tubes which are fabricated from ceramic materials. A typical example of such a gas filled electron tube is the thyratron. Essentially, a thyratron has a grid placed between the anode and cathode and is a hot cathode, gas filled, switch tube having such a grid.

Pulsed outputs of a thyratron may be controlled by means of a positive DC voltage which is applied to the thyratron grid. A voltage greater than critical must be applied to permit conduction but after conduction starts, reduction in grid voltage does not affect conduction. This action produces a high peak to average load current ratio. Hence, thyratrons are manufactured in most of the gas filled switch tube sizes with ratings up to tens of thousands of volts in regard to peak forward and inverse voltages together with extremely large ampere ratings.

As indicated above, many thyratrons employ glass envelopes and other glass supporting structures while certain higher power thyratrons employ typical ceramic structures. The manufacture and construction of both glass and ceramic thyratrons are well known in the art. It is immediately noted that a thyratron is one example of a gas filled tube to which the present invention applies in general.

In any event, a distinct advantage of a glass envelope thyratron construction over a comparable ceramic device of similar rating is the neutral (non-ionized) gas flow path which shunts the main discharge and is contained within a metal/mesh, internal axial structure. This annular cross-sectional volume, located coaxially between the outside of the discharge containment structure and the inner glass envelope wall, provides a source path for neutral molecular hydrogen, from the gas reservoir located at the base of the tube, to the anode-grid region, where electronics are pumped. Gas is collisionally ionized in this tube region and heat is generated during the commutation and conduction phases of the thyratron operation. Maximum thyratron operating frequency is limited by the recombination (recovery) time. Recombination, a three body boundary surface reaction, is a strong function of long lived atomic, metastable and rotational energy gas species. It is expedited by the available "cold", neutral gas molecules flowing into the gap region through the electron mean-free-path (mfp) diameter holes of the mesh structure, into the discharge bulk volume of the gas tube.

Additionally, the maximum conduction current rating is a function of the neutral gas available for ionization (to prevent gas starvation) and thus switching capability is favorably enhanced by the above-described mechanism.

In any event, there is no "outside the discharge" path in a conventional ceramic envelope device. In such a device all gas flow must pass through the constrictions in the grid apertures and the baffle holes.

It is, therefore, an object of the present invention to create a parallel neutral, low temperature, molecular gas circulation path while concurrently avoiding long path discharge (PASCHEN breakdown) in a ceramic envelope device.

It is a further object to provide an "outside the discharge" path for a ceramic envelope device which will enable such a device to have the beneficial gas circulation characteristics of a glass envelope device while capable of more rugged operation, together with a higher power ceramic metal structure.

SUMMARY OF THE INVENTION

In a gas filled electron tube of the type having a ceramic envelope and having a coaxial grid, cathode and anode, the improvement in combination therewith comprising, at least one annular surface radiator means associated with one of said tube electrodes and having on said surface a plurality of spaced apart apertures to provide a constant path cross section for neutral gas circulation within said tube about the main discharge path of said tube.

BRIEF DESCRIPTIONS OF FIGURES

DETAILED DESCRIPTION OF INVENTION

Figure 1:
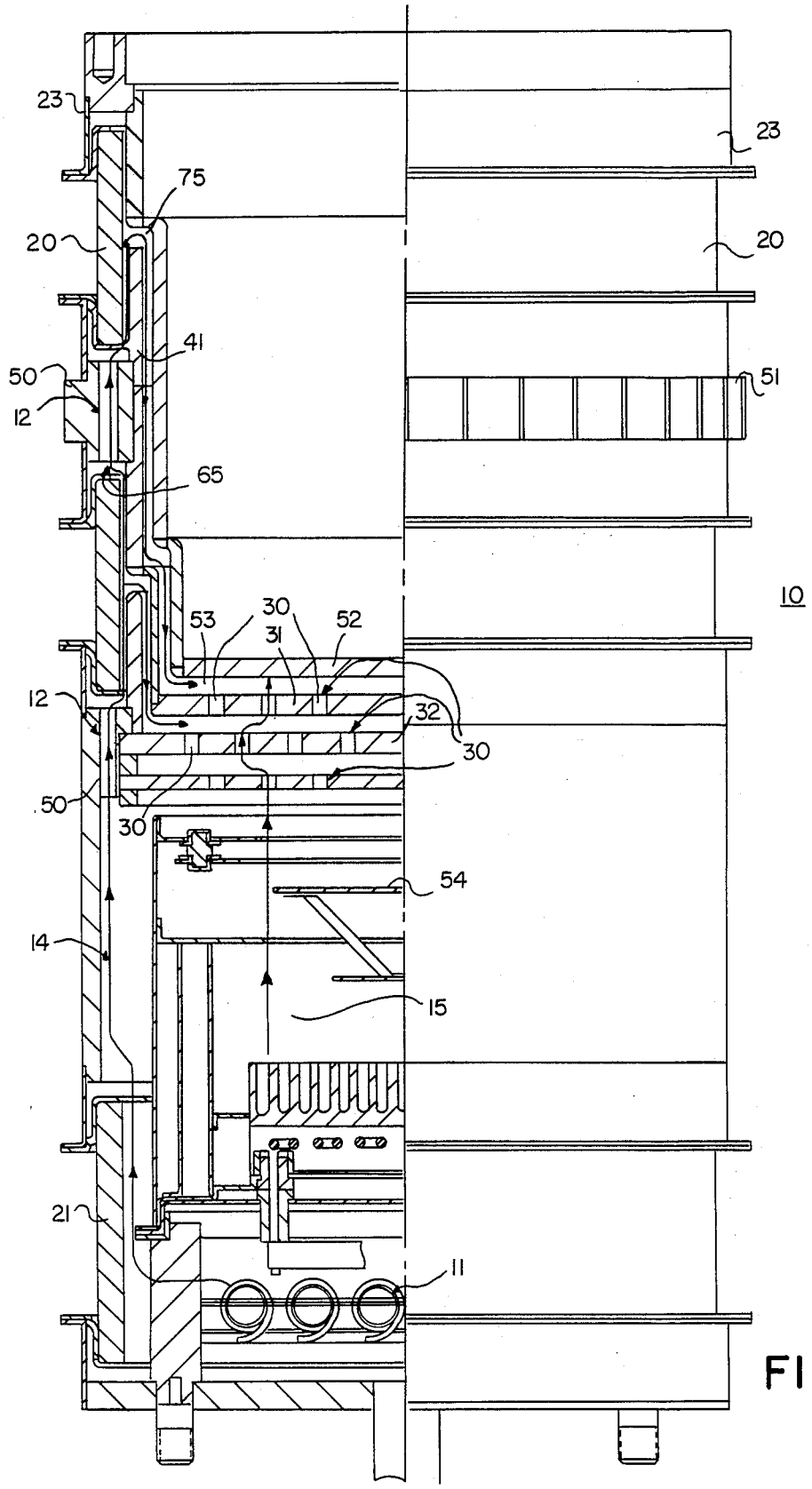
FIG. 1 is a front plan view showing a partial cross section of a gas filled ceramic electron tube according to this invention.

Referring to FIG. 1 there is shown a front plan view of a typical thyratron device 10. Such devices are manufactured by the assignee herein and, for example, the device of FIG. 1 may be a six inch diameter ceramic hydrogen thyratron 10 sold by ITT Electron Technology Division of Easton, Pa. FIG. 1 shows a typical cross-sectional partial view of a typical gas filled ceramic thyratron device 10. In such ceramic devices the entire outer wall or envelope consists of various ceramic sections which are sealed to one another by metal, glass seals 23 or otherwise, as sections 20, 21 and so on.

In any event, as one can ascertain from FIG. 1, arrow 14 designates the neutral gas shunt path while arrow 15 designates the main discharge path. Located in the base of the tube 10 is a reservoir or source of gas 11. As one can see from FIG. 1, a series of holes or baffles, such as 30, are associated with the grid structure to provide the main discharge path 15. A series of concentric holes 12 are drilled or otherwise formed through the grid radiator rings (two grid rings) 50 to simulate and provide the outer neutral gas region or path 14. These holes 12 simulate the outer neutral gas region of a glass envelope tube structure and provide the effects as described above. The holes 12 are located such that the long path discharge (breakdown) is prevented by non line of sight location and less than 1.0 mfp electrode to ceramic wall spacing, as in conventional ceramic tube construction.

The hole size for each aperture 12 is defined by equating the total hole area to the annular cross sectional area of the electrode outer diameter (OD) to the ceramic inner diameter (ID) space. This provides a constant path cross section for neutral gas circulation within the tube around the main discharge path as shown by paths 14 and 15 and directing the neutral gas to the anode-grid region 53 between anode 52 and grid 31.

As one can ascertain from FIG. 1, the gas from the source 11 follows the neutral gas shunt path as indicated by arrow 14. There are shunt path holes, such as holes 12, which essentially allow this gas to pass through a top passage 75 back to the grid electrode 31 where it circulates and where the main discharge path 15 is accommodated via the apertures or baffles 30 in the first and second grid electrodes, as 31 and 32. Thus, one has created the above-described desirable effect in that the ceramic tube 10 now has an outside discharge path 14 where neutral gas can flow through the outer apertures 12 in the grid rings 50. Hence, the above apertures now allow a neutral (non-ionized) gas flow path which shunts the main discharge path 15 contained within the brazed metal, internal structure.

Figure 2:
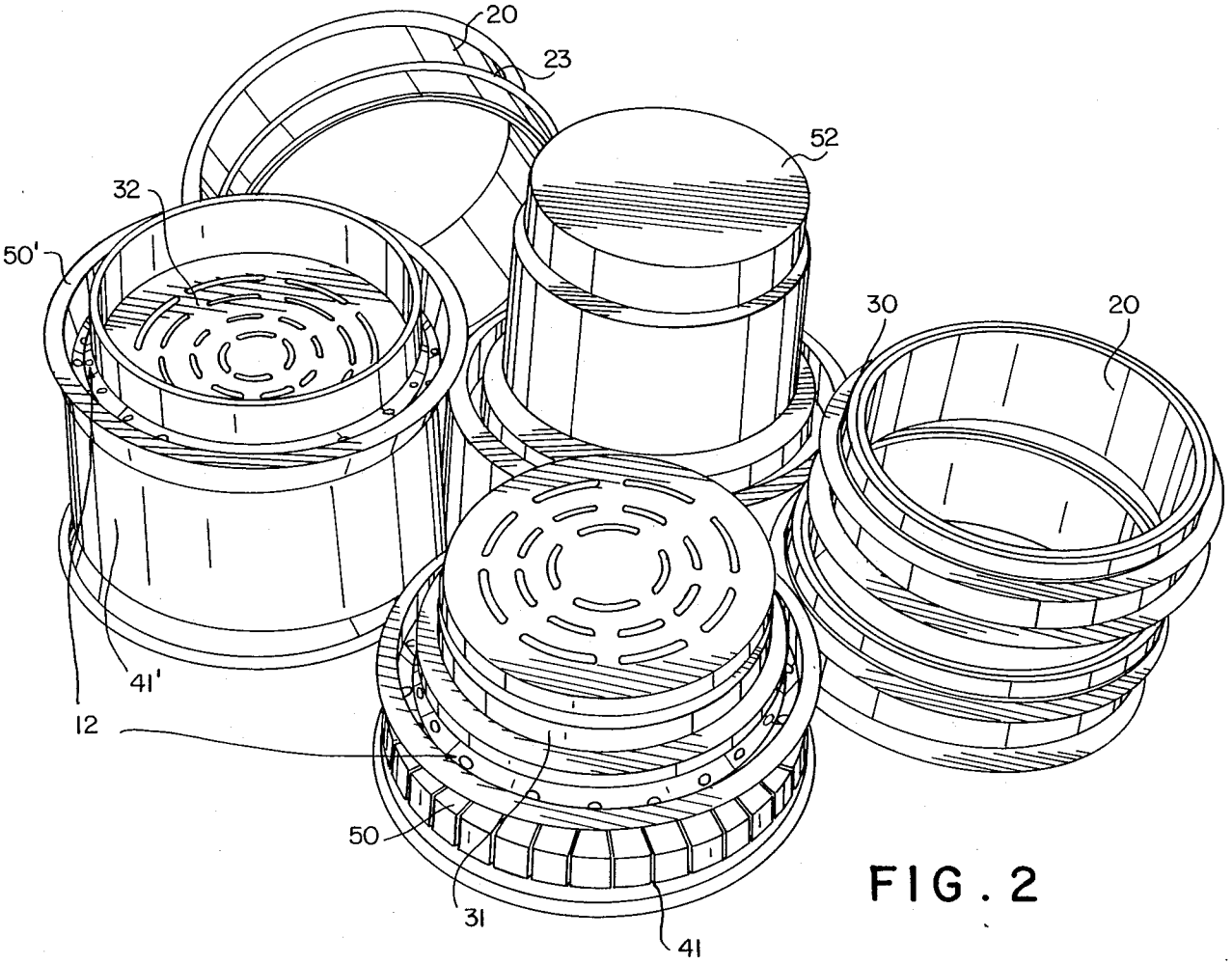
FIG. 2 is a series of perspective plan views of the various parts of a ceramic gas filled tube constructed according to this invention.

Referring to FIG. 2 there is shown the actual parts of an actual thyratron having the above-described apertures, according to this invention. Reference numeral 41 shows a typical grid assembly construction with the exception that it has now the shunt path holes 12 in radiator ring 50 which operate as above described. One can also see the top portion of the grid structure 41', together with the suitable shunt path holes 12 in grid ring 50'. The grid also has a grid aperture and baffle opening 30, as opening. The remaining parts consist of the anode 52 and cathode 54 (located inside of grid 31,) the second grid 32 with its associated radiator ring 50' and shunt apertures 12, ceramic sections 20, and the seals 23 on the ceramic sections, all of which are included in the entire ceramic thyratron assembly.

Figure 3A:
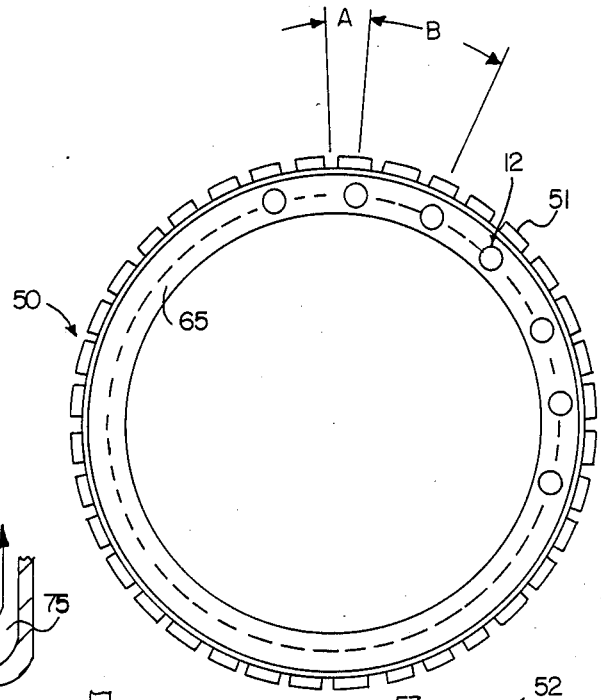
FIG. 3 is a more detailed diagram of structure according to this invention and comprises FIG. 3A, FIG. 3B and FIG. 3C, all of which are related to the same structure, as will be described.

Referring to FIG. 3A there is shown a top plan view of a typical grid radiator ring 50 employed in a gas-filled ceramic thyratron. As one can see, the radiator ring 50 has a series of peripheral extending tabs 51 which are spaced by slots. Essentially there are typically 36 slots each being 0.057 inches with the overall diameter of the radiator ring being 6.621 inches. The radiator ring has a peripheral flange 65 which flange contains a series of spaced apertures 12. Each aperture is drilled into the peripheral flange and is approximately 0.201 inches in diameter and there are twenty such apertures drilled about the periphery of the grid radiator ring 50. These are the apertures which provide the outside discharge path. The ring 50 is typically constructed of copper but differs from prior art rings in regard to the apertures 12 drilled therethrough.

As seen in the drawing, the angle A is typically 5° while the angle B is typically 20°. Based on the angle B of 20°, there are eighteen equally spaced holes 12, each being 20° apart, located about the inner peripheral ridge 65 of the radiator ring 50. The entire ring is fabricated from copper, as is well known. Each hole 12 is selected and calculated to be 0.101 inch in diameter formed by a #7 drill bit.

Figure 3C:
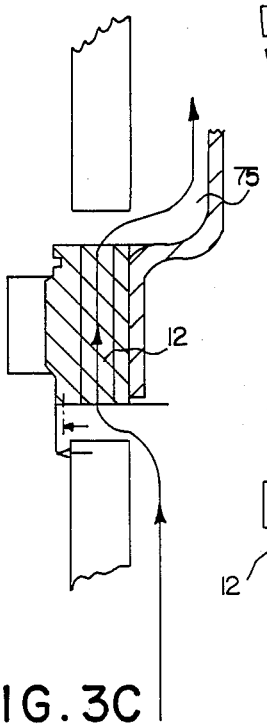
Figure 3B:
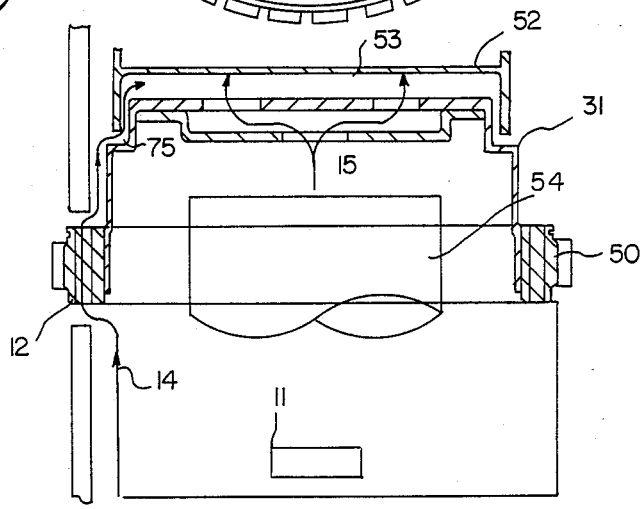

Referring to FIG. 3B, there is shown a schematic view of the radiator ring 50 emplaced within a typical thyratron where the ring 50 is brazed to the grid electrode 31. Numeral 54 designates the cathode structure which, of course, emits electrons. There is a gap 75 between the combined ring/grid structure 41 with arrow 15 designating the main discharge path. Also shown in FIG. 3B is a gas reservoir 11 which stores and dispenses hydrogen gas, as is well known. Essentially, as one can understand, reference numeral 14 refers to the neutral hydrogen shunt path which, as one can ascertain, passes through the aperture 12 and is directed via aperture 12 into the suitable gap 75 forming the shunt discharge path 14, as above indicated.

FIG. 3C shows an enlarged view of the structure depicted in FIG. 3B. The view of FIG. 3C shows exactly the neutral hydrogen shunt path 14 and operating in conjunction with a typical ceramic gas filled thyratron device. It is understood immediately that the above construction may be employed in any gas filled device to equalibriate gas pressure where pressure or density gradients are generated by the ion pumping action of high current electron flow. Thus, based on this technique, one has provided an outside discharge path for a conventional ceramic envelope gas filled device where normally all gas must flow through the constrictions provided in the grid apertures and the baffle holes.

Thus, by creating this parallel path, while concurrently avoiding long path discharge, a ceramic envelope device has all the major gas circulation advantages of an associated glass envelope device. Hence, such ceramic devices incorporating such structure will provide more rugged operation while capable of operating at even high powers than those associated with such ceramic devices in the prior art.

What is claimed is:

1. In a gas filled electron tube of the type having a ceramic envelope and having a planar grid, cathode and anode electrodes, the improvement in combination therewith comprising:

at least one annular surface radiator means associated with one of said electrodes and having on said surface a plurality of spaced apart apertures to provide a constant path cross section for neutral gas circulation within said tube about the main discharge path of said tube.

2. The electron tube according to claim 1 wherein said tube is a ceramic thyratron with said one of said electrodes being the grid electrode.

3. The electron tube according to claim 2 wherein said gas is hydrogen or deuterium gas and said thyratron is a hydrogen ceramic thyratron.

4. The electron tube according to claim 1 further including a second annular surface radiator means associated with a second of said electrodes and having a plurality of concentric, spaced apart apertures.

5. The electron tube according to claim 1 wherein said plurality of apertures extend about said annular surface and are equally spaced one from the other.

6. The electron tube according to claim 1 wherein said annular surface radiator means is fabricated from copper.

7. The electron tube according to claim 1 wherein each of said apertures has a diameter selected according to equating the total aperture area to the annular cross section of said radiator means outer diameter to the ceramic envelope inner diameter space.

8. The electron tube according to claim 1 further including a series of peripheral extending tabs located about the outer periphery of said annular surface radiator means.

9. The electron tube according to claim 1 wherein said apertures are selected such that the long path discharge (breakdown) is prevented by non-line of sight aperture location and less than one electron mean-free-path (mfp) electrode to ceramic wall spacing.

10. The electron tube according to claim 5 wherein said apertures are spaced twenty degrees apart and therefore are eighteen apertures.

11. The electron tube as claimed in claim 1 wherein:

said annular surface radiator means comprises a generally cylindrical portion and a flange portion, said generally cylindrical portion being positioned generally concentrically within said ceramic envelope and having first and second ends, said flange portion being at said first end of said cylindrical portion and extending radially at least to said ceramic envelope, said second end of said cylindrical portion being secured to said tube electrode, an outer surface of said generally cylindrical portion of said annular surface radiator and an inner surface of said ceramic envelope defining a cylindrical path for neutral gas flow, said cylindrical path having a given cross section, said flange portion being positioned to entirely obstruct said cylindrical path for neutral gas flow, said spaced apart apertures being on said generally cylindrical portion of said annular surface radiator means.

12. The electron tube as claimed in claim 11 wherein:

said tube electrode is a grid electrode.

13. The electron tube as claimed in claim 11 wherein:

said apertures have a combined aperture area approximately equal to said given cross section.

14. The electron tube as claimed in claim 11 wherein:

said apertures are equally spaced about the circumference of said cylindrical portion.

15. A method of providing neutral gas flow in a gas filled electron tube of the discharge type having a ceramic envelope and having an electrode associated radiator member to provide a source path for neutral molecular gas flow from the electron tube gas reservoir to an anode-grid region, comprising the steps of:

forming a plurality of concentric holes in said electrode radiator member of said tube at locations such that the long path distance charge is prevented to thus provide a constant path cross section for neutral gas around the main discharge path.

16. The method according to claim 15 wherein said gas is selected form hydrogen and deuterium.

17. The method according to claim 15 wherein said electron tube is a thyratron.

18. The method according to claim 15 wherein said electrode radiator member is a grid radiator ring having an annular surface.

19. The method according to claim 18 wherein said apertures as formed are equally spaced around the annular surface of said grid radiator ring.

20. The method according to claim 19 wherein said grid radiator ring includes extending tabs located about the outer periphery of said grid radiator ring.

* * * * *